United States Patent [19]

Croghan

[11] 4,244,663

[45] Jan. 13, 1981

[54] APPARATUS FOR RESTRICTING PIPE MOTION

[75] Inventor: Stephen M. Croghan, Houston, Tex.

[73] Assignee: Marathon Manufacturing Company, Houston, Tex.

[21] Appl. No.: 973,155

[22] Filed: Dec. 26, 1978

[51] Int. Cl.[3] ..... E02D 21/00

[52] U.S. Cl. ..... 405/195; 175/5; 166/367

[58] Field of Search ..... 405/201, 195, 207, 209; 166/367, 350, 359, 79; 175/10, 7, 5

[56] References Cited

U.S. PATENT DOCUMENTS

| | | | |
|---|---|---|---|
| 757,960 | 4/1904 | Phillips | 175/10 |
| 1,596,341 | 8/1926 | Dormoy | 175/5 X |
| 3,001,594 | 9/1961 | Suderow | 405/201 X |
| 3,142,343 | 7/1964 | Otteman et al. | 175/7 |
| 3,145,775 | 8/1964 | McCarty | 175/7 X |
| 3,456,745 | 7/1969 | Peri | 175/5 |
| 3,508,409 | 4/1970 | Cargile | 175/5 X |

*Primary Examiner*—Dennis L. Taylor
*Attorney, Agent, or Firm*—Vinson & Elkins

[57] ABSTRACT

An apparatus for restricting the lateral motion of a pipe column extending upward from the bottom of a body of water to a point above the surface of the water. The apparatus finds its preferred use as a drive pipe stabilizer for a cantilever-type offshore drilling barge or the like.

12 Claims, 8 Drawing Figures

APPARATUS FOR RESTRICTING PIPE MOTION

BACKGROUND OF THE INVENTION

The present invention relates to an improvement in a marine vessel such as a cantilever jack-up drilling barge or the like for use in underwater operations. More particularly, the present invention relates to an improved offshore drilling rig assembly.

In relatively shallow offshore oil drilling operations of the type conducted from an offshore platform or a jack-up type barge it is conventional for the external drive pipe, or conductor, to be free standing from the ocean floor to a point above the surface of the water and just below the drilling rig. The drive pipe is driven into the ocean floor with a pile driver to a depth of 200 or 300 feet and is cemented to the ocean floor at the mudline.

The drive pipe encloses a concentric arrangement of one or more drill pipe casings and a drill string. The drive pipe provides lateral support for the casings and drill strings from the drilling rig to the well bore and also typically provides support for the pressure control equipment normally referred to as "blow out preventers". Alternatively, the drill pipe casings may be supported at the level of the ocean floor. In either arrangement, the drive pipe provides fluid communication to the drill hole as well as support for the blow out preventers and drill pipe casings.

The drive pipe and drill pipe casings terminate just before the pipe column reaches the drilling platform. The drill string continues through the pressure control equipment affixed to the end of the pipe column.

The action of the ocean waves on the free standing pipe column comprising the drive pipe and drill pipe casings causes the column to sway. Such wave-induced lateral displacement of the pipe interferes with normal drilling and producing operations.

The magnitude of the pipe column's lateral displacement can be reduced if the pipe column is provided with lateral support from the barge. This may be accomplished by connecting to the barge a restricting assembly that hangs beneath the barge and grips the outer pipe of the pipe column. Such lateral support stabilizes the pipe column against the laterally dislocating forces of the ocean waves.

Some special problems must be overcome to attach a restricting assembly to a cantilever type jack-up drilling barge. The cantilever beams which extend outboard over the ocean during drilling and production operations must be retracted when the barge is to be moved to a new location. If the restricting assembly that hangs beneath the drilling platform to stabilize the pipe column is permanently affixed below the level of the cantilever beams, then the restricting assembly would interfere with the retraction of the cantilever beams. Since the deck of the barge under the cantilever beams is used for storage of drill pipe, and since that area must remain free of obstruction, a restricting assembly permanently affixed above the level of the cantilever beams is also not practical.

OBJECTS OF THE INVENTION

It is an object of this invention to provide a simple, efficient and economic means for restricting the lateral motion of a pipe column extending upward from the bottom of a body of water to a point above the surface of the water, said restricting means adaptable to be mounted on a marine vessel such as an offshore drilling barge or the like.

Another object of this invention is to provide pipe column restricting means that may be easily stowed when not in use and that may be easily moved to and from stowed position so that a pipe column may be stabilized without interfering with normal drilling or servicing operations.

These and other objects and features of advantage of this invention will be apparent from the drawings, the detailed description, and the appended claims.

BRIEF DESCRIPTION OF THE DRAWINGS

In the drawings in which is shown a preferred embodiment the invention may assume, and in which like numerals indicate like parts.

DESCRIPTION OF THE PREFERRED EMBODIMENTS

Figure 1:
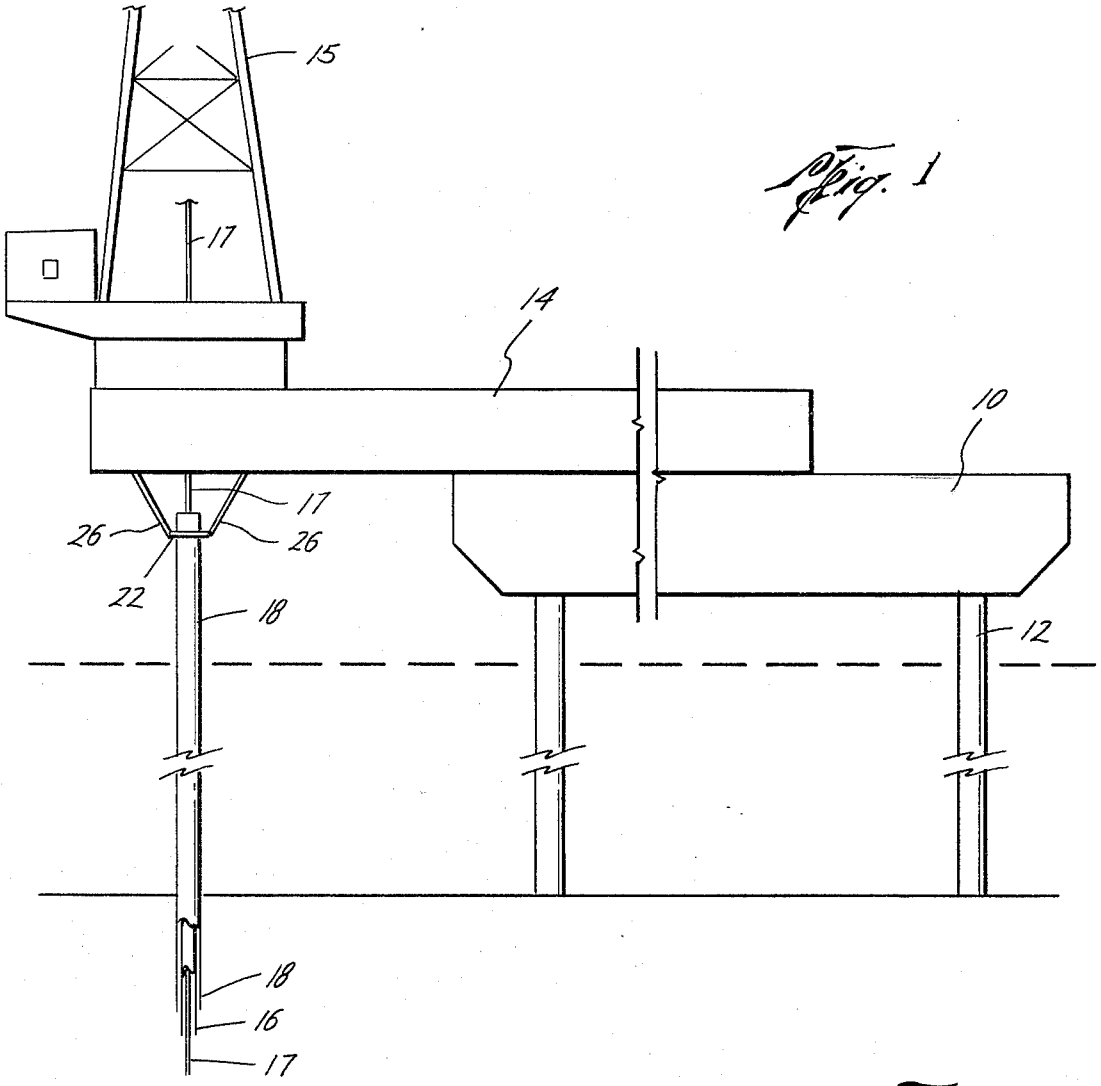
FIG. 1 is a side view of a jack-up cantilever type drilling barge showing the barge and the present invention in drilling or operating position.

Referring to the drawings, 10 indicates a marine vessel such as a floating barge or the like which can be anchored to the ocean bottom and raised above the level of the water by means of supporting columns 12. The barge 10 may be provided with a drilling platform 14, which may be slidably connected to the barge so that the platform may be extended outboard over the surface of the water in cantilever fashion. A derrick 15 on the cantilevered portion 14 may be used for drilling operations when the cantilevered portion is in its outboard position.

With the cantilever section 14 of the barge extended, a pipe column 18 is extended to the floor of the ocean and is driven by pipe driving means (not shown) into the ocean floor to a depth of 200 to 300 feet. With the pipe column 18 (i.e., the drive pipe) anchored in the ocean floor, one or more drill pipe casings 16 may be concentrically inserted into the pipe column 18 for drilling and producing operations.

When more than one drill pipe casing 16 is used, the outermost casing is cemented to the pipe column 18 at the mudline by extruding cement 20 into the annular space between the pipe column 18 and the drill pipe casing 16. Of course, if only one drill pipe casing 16 is used, then it is the outermost casing so cemented. For simplicity and clarity, only one drill pipe casing 16 will be depicted in the present description.

A rotary drill string 17 is disposed within the bore of the drill pipe casing 16 for rotating the drill bit in the well and for supplying drilling mud for lifting well cuttings up the annulus between the drill string 17 and the drill pipe casing 16.

The section of drill pipe casing 16 that is covered by the pipe column 18 is that section which extends from a point 200 or 300 feet below the floor of the ocean to some point above the surface of the water where the drill pipe casing 16 and pipe column 18 are connected to the pressure control equipment (not shown). The drill string 17 continues through the pressure control equipment to the drilling platform 14.

The pipe column 18 which encloses the drill pipe casing 16 and the drill string 17 is free standing and has no external point of support other than that indirectly imparted by the drill pipe casing 16 and the drill string 17.

The present invention is designed to give lateral support to the pipe column 18 against forces generated by the action of the ocean waves. The preferred embodiment of the invention accomplishes this aim by providing lateral support via a restricting assembly comprising a restricting frame 22 fitted with pipe engaging bumpers 24 and suspended from the cantilever section 14 of the barge by rigid elongate metal rods 26.

Figure 4:
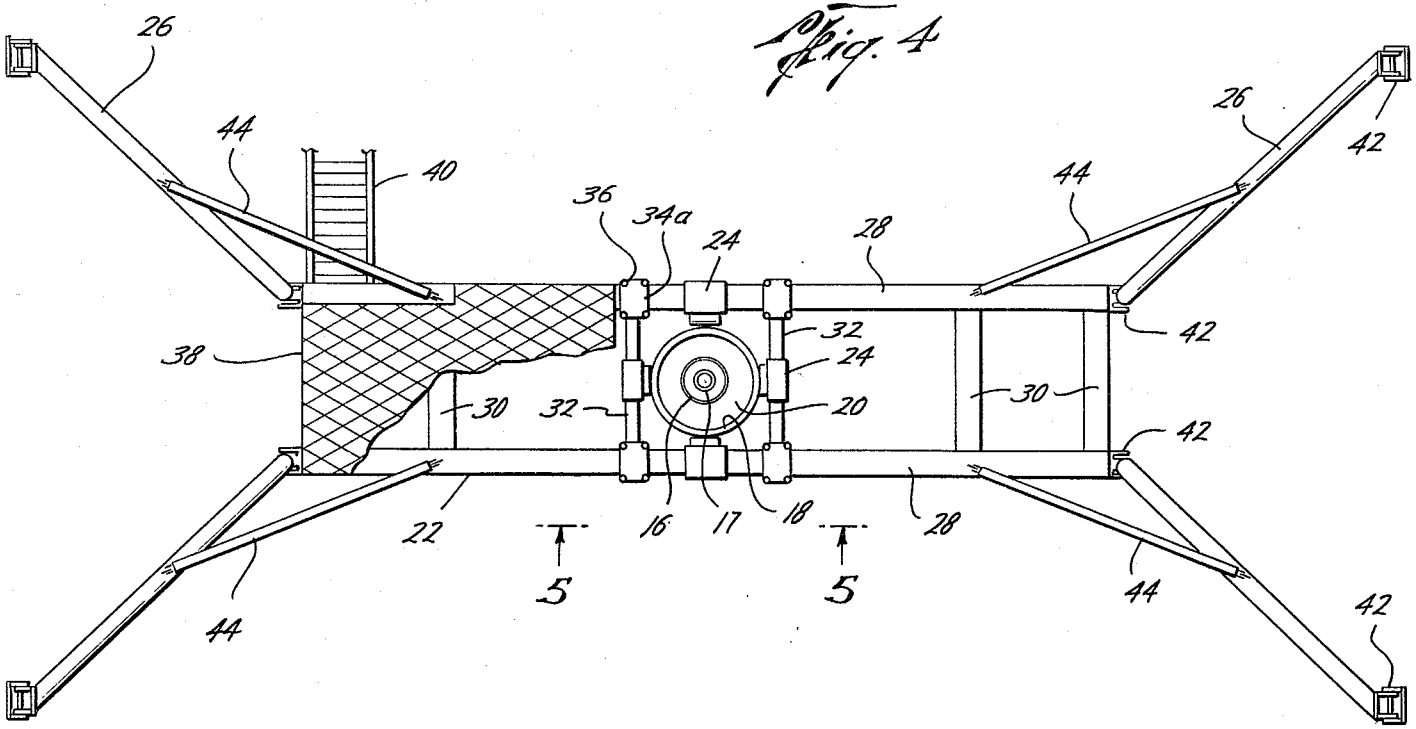
FIG. 4 is a plan view of the movement restricting apparatus of the present invention including the pipe column restricting frame and its supporting means.

Referring to FIG. 4, the restricting frame 22 comprises two parallel elongate frame members 28 rigidly connected by cross beam frame members 30 so that the elongate frame members 28 remain essentially parallel to each other at a fixed distance. The length of the cross beam frame members 30 is chosen so that the distance of separation between the elongate frame members 28 is slightly greater than the outer diameter of the pipe column 18 that passes between the two parallel elongate frame members 28.

That means carried by the restricting frame 22 for restricting the lateral motion of the pipe column 18 comprise two cross braces 32, described below, and a plurality of pipe engaging bumpers 24 attached to the elongate frame members 28 and to the cross braces 32. One end of each cross brace 32 is connected to one of the elongate frame members 28 and the other end of each cross brace 32 is connected to the other elongate frame member 28. Thus, the cross braces 32 are affixed to the restricting frame so that they are both relatively parallel to each other and relatively perpendicular to the elongate frame members 28. The cross braces 32 are affixed to the restricting frame so that they are separated by a distance slightly greater than the outer diameter of the pipe column 18. The cross braces 28 together with the elongate frame members 28 form a generally rectangular enclosure through which the pipe column 18 narrowly passes. The pipe column 18 is prevented from rubbing against said pipe restricting enclosure by attaching pipe engaging bumpers 24 to the elongate frame members 28 and the cross braces 32. During normal operations such bumpers touch or nearly touch the pipe column 18, thus entirely preventing or narrowly limiting lateral movement of the upper end of pipe column 18.

Figure 5:
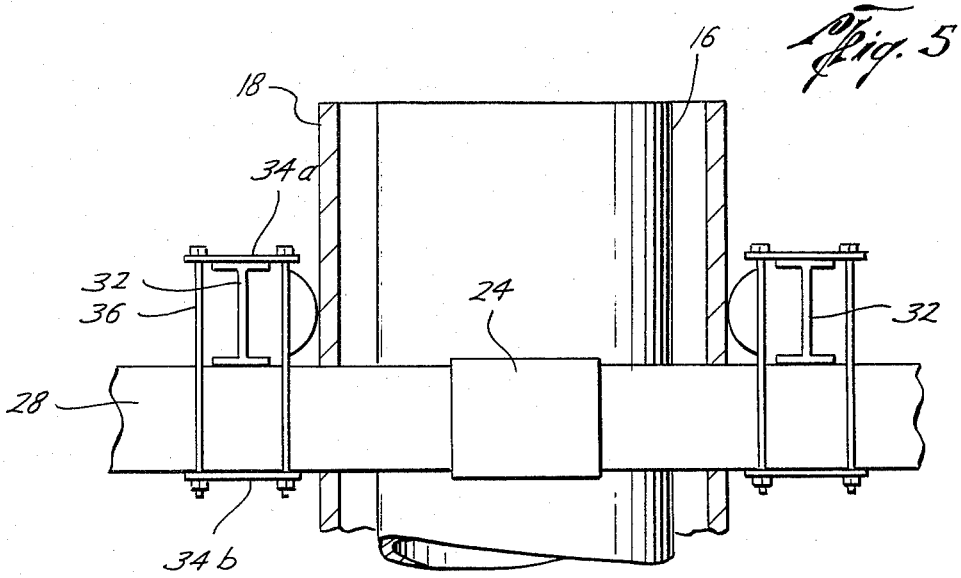
FIG. 5 is an enlarged detail view taken on the line 5—5 of FIG. 4 showing the construction and attachment of a portion of the pipe column restricting means.
Figure 2:
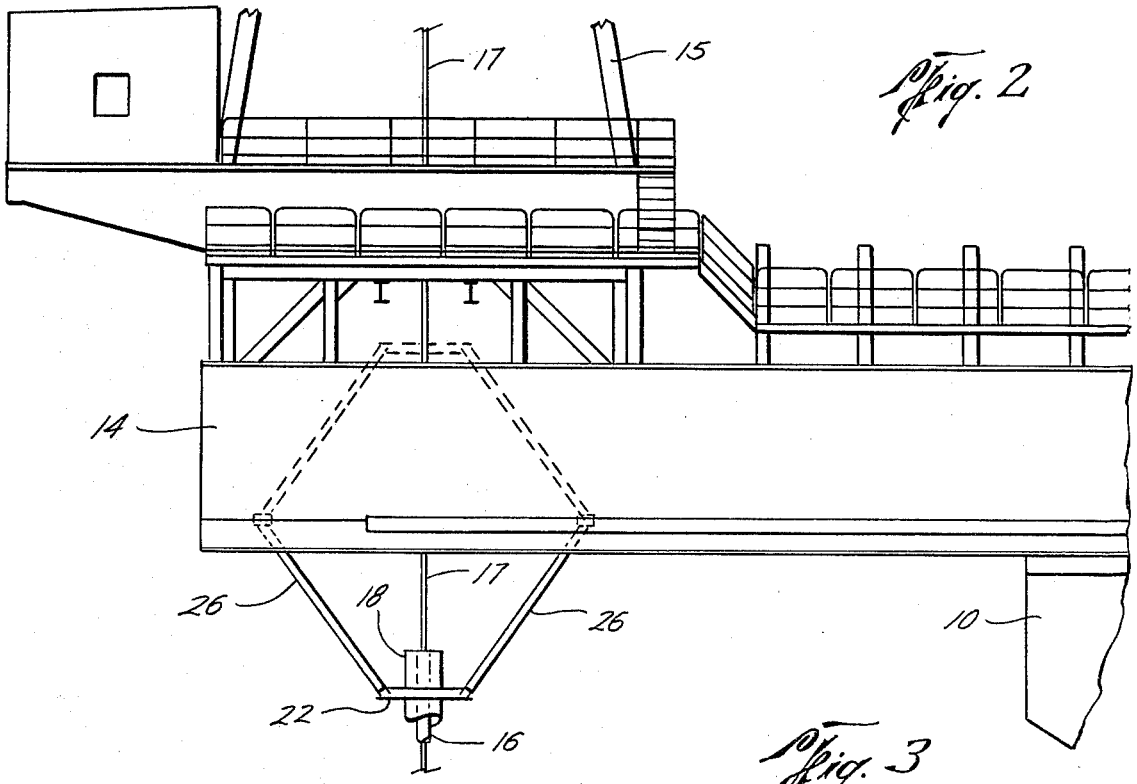
FIG. 2 is an enlarged, detailed side view of the cantilevered portion of the apparatus of FIG. 1, showing the attachment of the present invention to the barge in operating position (solid lines) and in stowed position (dotted lines)

Referring to FIG. 5, each cross brace 32 comprises an "I" shaped metal beam which is laid across and affixed to the two elongate frame members 28. The cross braces 32 are affixed by placing a flat rectangular-shaped metal flange plate **34*a* over the cross brace 32 and a similar flange plate 34*b* under an elongate frame member 28 at a point of connection and clamping the cross brace 32 to the elongate frame member 28, said clamping being accomplished by securing elongated bolts 36 through flange plate 34*a*, around cross brace 32, around elongate frame members 28, and through flange plate 34*b***.

Figure 3:
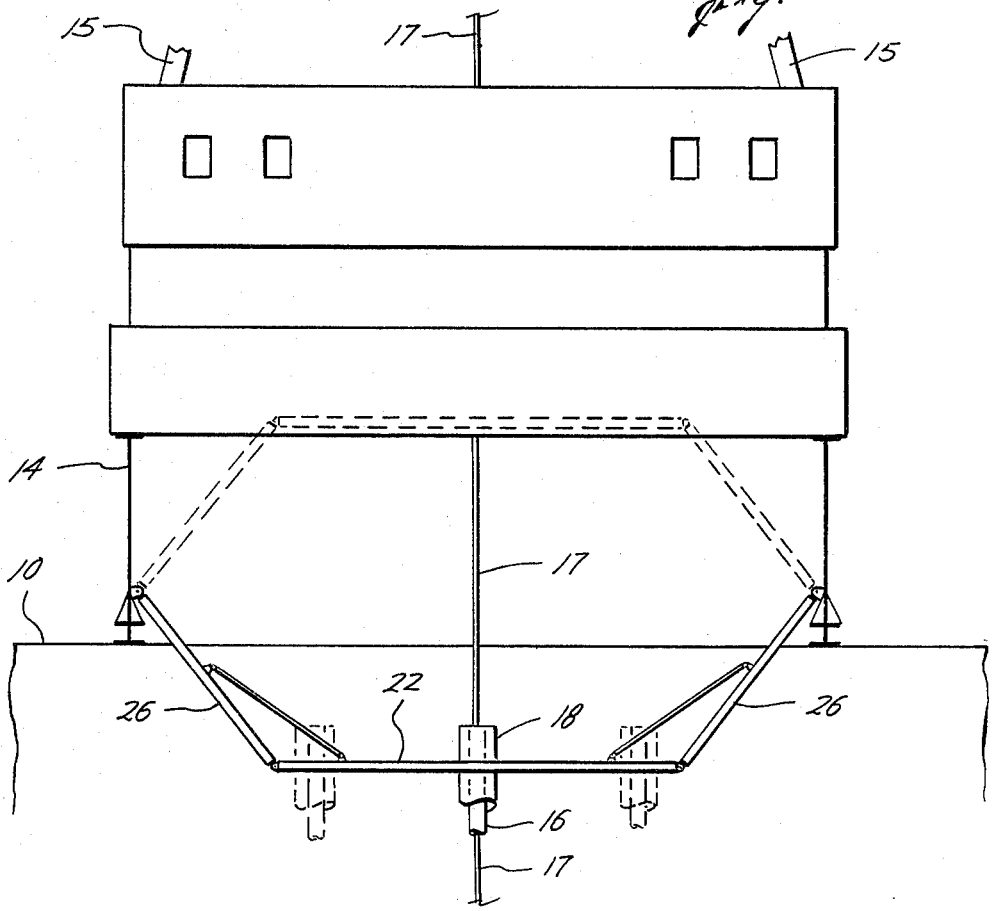
FIG. 3 is an enlarged, detailed end view of the barge showing the attachment of the present invention to the barge in operating position (solid lines) and stowed position (dotted lines)

The cross braces 32 are clamped to the elongate frame members 28 rather than being permanently affixed to them in order that the cross braces 32 can be moved to different positions on the restricting frame 22 to accommodate the pipe column 18 in a plurality of drilling positions. FIG. 3 indicates the extent of lateral placement of the cross braces 32 on the restricting frame 22 by showing in dotted outline the position that pipe column 18 would occupy at each end of the restricting frame. FIG. 4 shows wire mesh flooring 38 covering the portions of the restricting frame 22 outside the rectangle formed by the cross braces 32 and the elongate frame members 28. Also shown is an accommodation ladder 40 which allows access to the area of the restricting frame 22 covered by the wire mesh flooring 38.

The restricting frame 22 is attached to the cantilever section 14 of the barge by four elongate metal rods 26. Each elongate metal rod 26 is pivotally attached to a corner of the restricting frame 22 and is pivotally attached to the cantilever section 14 of the barge by metal pivot joint assemblies 42. The pivot in each metal pivot joint assembly 42 is generally parallel to the cross beam frame members 30 of the restricting frame 22. This arrangement permits the restricting frame 22 and the four elongate metal rods 26 pivotally attached to it to have considerable flexibility and freedom of motion in a plane perpendicular to the direction of the cross beam frame members 30. The restricting frame 22 and the pivotally attached elongate metal rods 26 have relatively little freedom of motion in the direction of the cross beam frame members 30.

When the restricting assembly is in position to restrict the motion of the pipe column 18, the flexibility provided by the pivotal attachment of the elongate metal rods 26 must be reduced in order to give the restricting assembly sufficient rigidity with respect to the cantilever section 14 of the barge to restrict the lateral motion of the pipe column 18. The restricting assembly is made rigid via mechanically detachable bracing means in the form of rigid struts 44 which connect the restricting frame 22 with the elongate metal rods 26. The end of each strut 44 is forked and is adapted to receive a pin through the furcations of said forked end in order to attach the strut 44 to the restricting frame 22 and each of the elongated metal rods 26. When all four of the struts 44 are attached the restricting assembly is suitably rigid. The struts 33 are removed during the stowing process described below.

Figure 6A:
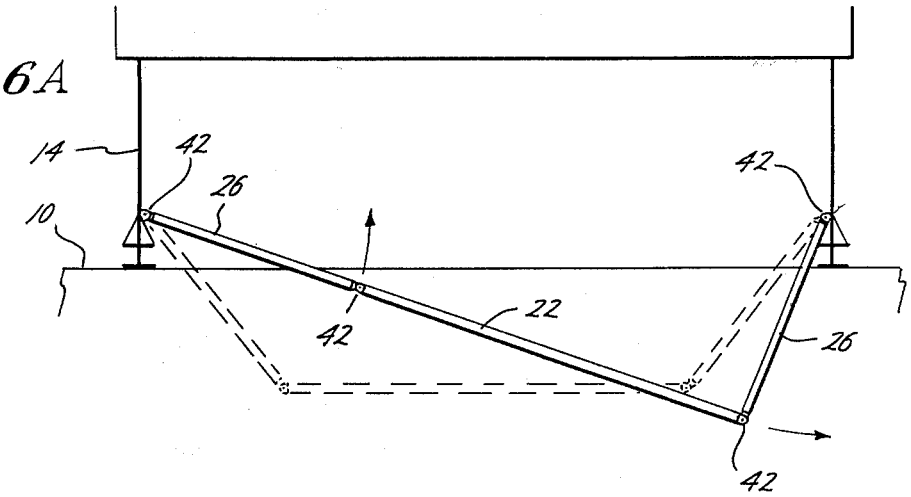
FIG. 6A is a somewhat diagrammatic end view of the apparatus of the invention illustrating the initial movements of the restricting assembly when the restricting assembly is being stowed.

The flexibility of the restricting assembly described above permits the restricting frame 22 and the pivotally attached elongate metal rods 26 to be easily maneuvered into a stowed position while the elongate metal rods 26 remain pivotally attached to the cantilever section 14 of the barge. Referring to FIG. 6A, the dotted outline diagrammatically represents the position of the restricting assembly when it is in position to restrict the motion of the pipe column 18. The solid lines diagrammatically represent the initial movements of the restricting assembly when the restricting assembly is being stowed. After the assembly has been disengaged from the pipe column 18 and drill pipe casing 16, the restricting assembly is pulled to one side of the center line of the cantilever section 14 of the barge until the pivotally elongate metal rods 26 on the other side of the restricting frame 22 come into planar alignment with the restricting frame 22.

Figure 6B:
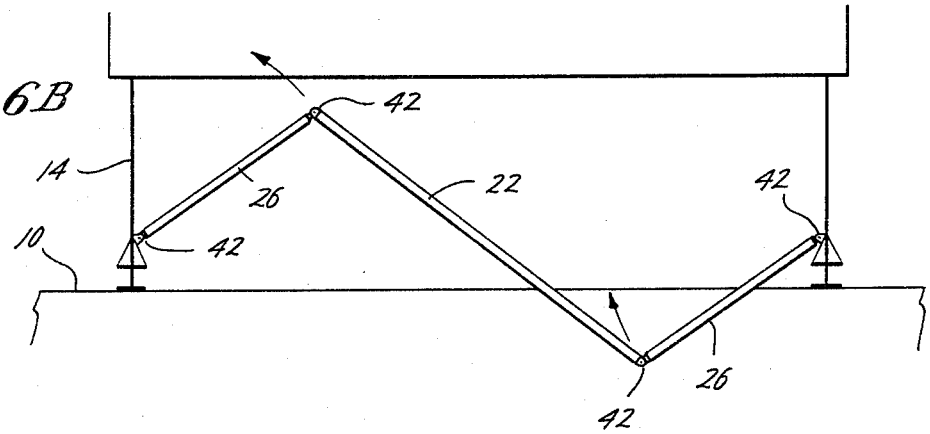
FIG. 6B is a view similar to FIG. 6A illustrating the movements of the restricting assembly at an intermediate point in the stowing process.

Referring to FIG. 6B which illustrates the movements of the restricting assembly during an intermediate point in the stowing process, the restricting assembly is moved back toward the center line of the cantilever section 14 of the barge causing the pivotally attached metal rods 26 on the far side of the restricting frame 22 to move upward out of planar alignment with the restricting frame 22.

Figure 6C:
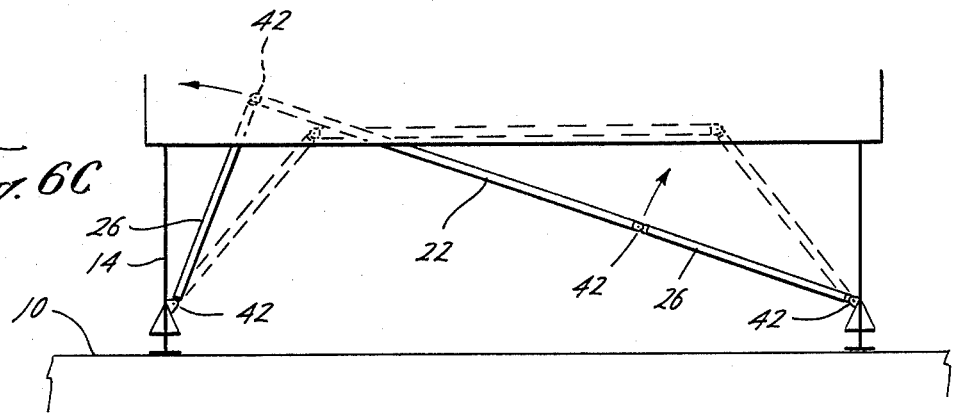
FIG. 6C is a view similar to FIGS. 6A and 6B illustrating the movements of the restricting assembly during the final stages of the stowing process.

Referring to FIG. 6C which illustrates the movements of the restricting assembly during the final stages of the stowing process, the upward movement of the restricting frame 22 is continued. The restricting frame 22 comes into planar alignment with the second set of pivotally attached elongate metal rods 26. At this point, the direction of motion of the restricting frame 22 is reversed, and the restricting frame 22 is once again moved back toward the center line of the cantilever section 14 of the barge in such a manner that the restricting frame 22 moves upward out of planar alignment with the second set of pivotally attached elongate metal rods 26.

The restricting assembly comes to rest and may be secured in the stowed position diagrammatically indicated by the dotted outline in FIG. 6C. In the stowed position as shown, the restricting assembly does not hang down below the level of the cantilever section 14 of the barge and does not, therefore, interfere with the retraction of said cantilever section. Further, the restricting assembly in stowed position is well above the deck area of the barge 10 used for the storage of drill pipe. When the cantilever section 14 of the barge is retracted, the restricting assembly in stowed position freely clears obstructions on the storage deck of the barge 10.

From the foregoing, it may be seen that the objects of this invention have been obtained. There has been provided simple and efficient means for restricting the lateral motion of a pipe column in offshore drilling or producing operations. The invention may be easily stowed when not in use and may easily be moved to and from stowed position. The invention may be stowed so that it does not interfere with any drilling or producing operations.

The foregoing disclosure and description of the invention are illustrative and explanatory thereof, and various changes in the size, shape and materials, as well as in the details of the illustrated construction, may be made within the scope of the appended claims without departing from the spirit of the invention.

What is claimed is:

1. A restricting assembly adaptable to be mounted on a marine vessel for restricting the lateral movement of a pipe column extending upward from the bottom of a body of water to a point above the surface of the water, said restricting assembly comprising:

a restricting frame;

rigid suspension means for pivotally suspending said restricting frame from the vessel; and bracing means carried by the restricting frame for interconnecting said restricting frame and said rigid suspension means for restricting the lateral movement of the restricting frame;

said restricting frame and its rigid suspension means being pivotally adjustable to a stowed position on the vessel when the restricting frame is not in use.

2. The restricting assembly set forth in claim 1 wherein said rigid suspension means are also pivotally connected to the restricting frame so that the restricting assembly possesses sufficient flexibility to be maneuvered into stowed position.

3. The restricting assembly set forth in claim 1 wherein said bracing means are rigid struts adapted for connection to said restricting frame and to said rigid suspension means whereby the restricting assembly may be made rigid with respect to said vessel when it is in position to restrict the lateral motion of the pipe column and when it is in stowed position.

4. The restricting assembly set forth in claim 4 wherein the rigid struts have forked ends, said struts being connectable to the restricting frame and rigid suspension means by a pin passing through the furcations of the forked end and through a part of the restricting frame or rigid suspension means adapted to fit between the furcations of the forked end of each strut.

5. The restricting assembly set forth in claim 1 comprising additionally a plurality of bumpers attached to the restricting frame in proximity to the pipe column for restricting the lateral motion of the pipe column.

6. In a cantilever type drilling barge, the improvement residing in a restricting assembly secured to the cantilever section of said cantilever barge for restricting the lateral movement of a pipe column extending upward from the bottom of a body of water to a point above the surface of the water, said restricting assembly comprising:

a restricting frame;

rigid suspension means for pivotally suspending said restricting frame from the cantilever section of the barge when said cantilever section is in an outboard position;

bracing means carried by the restricting frame for interconnecting said restricting frame and said rigid suspension means for restricting the lateral movement of the restricting frame;

said restricting frame and its rigid suspension means being pivotally adjustable to a stowed position within the cantilever section of said barge when the restricting frame is not in use so that the restricting frame will not interfere with the normal movement of the cantilever section relative to the main body of the barge.

7. The improvement set forth in claim 8 wherein said restricting frame in the stowed position is elevated above the barge deck, whereby the deck portion of said barge covered by said cantilever assembly remains free for storage.

8. The improvement set forth in claim 6 together with means for attaching the rigid suspension means to the cantilever section of the barge in such manner that said rigid suspension means remains attached to the cantilever section in all positions of said rigid suspension means.

9. The improvement set forth in claim 6 wherein said rigid suspension means are also pivotally connected to the restricting frame so that the restricting assembly possesses sufficient flexibility to be maneuvered into stowed position.

10. The improvement set forth in claim 6 wherein said bracing means are rigid struts adapted for connection to said restricting frame and to said rigid suspension means so that the restricting assembly may be made rigid when it is in position to restrict the lateral motion of the pipe column or when it is in stowed position.

11. The improvement set forth in claim 10 wherein the rigid struts have forked ends, said struts being connectable to the restricting frame and rigid suspension means by a pin passing through the furcations of the forked end and through a part of the restricting frame or rigid suspension means adapted to fit between the furcations of the forked end of each strut.

12. The improvement set forth in claim 6 comprising additionally a plurality of bumpers attached to the restricting frame in proximity to the pipe column for restricting the lateral motion of the pipe column.

* * * * *